United States Patent [19]

Kimmell

[11] 4,071,256

[45] Jan. 31, 1978

[54] TRUCK FOR SKATEBOARD OR THE LIKE

[75] Inventor: Steven Donald Kimmell, Granada Hills, Calif.

[73] Assignee: Mattel, Inc., Hawthorne, Calif.

[21] Appl. No.: 739,079

[22] Filed: Nov. 5, 1976

[51] Int. Cl.[2] ..... B62B 11/00

[52] U.S. Cl. ..... 280/11.28; 280/87.04 A

[58] Field of Search ..... 280/11.28, 80 R, 81 R, 280/81 A, 87.04 R, 87.04 A

[56] References Cited

U.S. PATENT DOCUMENTS

| | | | |
|---|---|---|---|
| 2,899,209 | 8/1959 | Reynolds et al. | 280/11.28 X |
| 3,104,887 | 9/1963 | Rice et al. | 280/11.28 X |
| 3,945,655 | 3/1976 | Banks | 280/11.2 |

*Primary Examiner*—Joseph F. Peters, Jr.
*Assistant Examiner*—Gene A. Church
*Attorney, Agent, or Firm*—John G. Mesaros; Stephen L. King; Robert W. Mulcahy

[57] ABSTRACT

A skateboard truck having a cup-shaped housing with the axis thereof transverse to a mounting plate member secured adjacent the housing opening, the bottom of the housing having pivotally secured thereto a trunnion supporting a transversely extending axle and wheel assembly. An annular rubber cushion fits within the cup in alignment with the axis thereof, the inner surface of the cup and the cushion being matingly configured to restrain the cushion from rotating. A member is received within the cushion, the member having diametrically opposed outwardly extending flanges received within splits within the cushion, the member being secured for rotation with the trunnion whereby the surfaces of the flanges apply circumferential compressive forces to the adjacent surfaces of the cushion during pivoting of the triunnion. Means are provided for axially varying the volume or density of the cushion whereby to vary the circumferential compressive forces resulting from pivoting of the trunnion.

14 Claims, 8 Drawing Figures

TRUCK FOR SKATEBOARD OR THE LIKE

BACKGROUND OF THE INVENTION

The background of the invention will be set forth in two parts.

1. Field of the Invention

The present invention pertains generally to the field of skateboards or the like and more particularly to a truck for use in such skateboards.

2. Description of the Prior Art

Trucks illustrative of those used in roller skates or skateboards are shown in U.S. Pat. No. 2,763,490 entitled "Roller Skate" issued to Crone on September 18, 1956, and U.S. Pat. No. 3,945,655 entitled "Brake for Skateboard and the Like" issued to Banks, et al. on Mar. 23, 1976. The devices of both of these patents utilize rubber cushions of two different configurations, the cushions in either event being intended to provide a resilient restoring force to the truck when the user of the skateboard or the roller skate, as the case may be, effects a turn by shifting his weight thereby causing rotation of the wheels with respect to an axis of the truck against this force. In both devices the cushion means coacts with metal to apply shearing forces to the rubber cushion during pivoting of the truck. The adjustment of the "rebound" force applied by the cushion is effected by compressing the cushion, which is not otherwise confined, thereby increasing the shearing force applied by the metal to rubber contact. A detailed discussion of the first of these two configurations will be discussed hereinafter with respect to FIG. 1.

Other prior art known to applicant is listed by way of illustration, but not of limitation, in a separate communication to the U.S. Patent Office.

The present invention exemplifies improvements over this prior art.

SUMMARY OF THE INVENTION

It is the primary object of this invention to provide a new and useful truck for use with a skateboard or the like.

It is another object of this invention to provide a new and improved truck assembly wherein the cushion means are confined and operate in a compressive manner.

The foregoing and other objects of the invention are accomplished by providing a truck for use with a skateboard or the like, the truck having a cup-shaped housing with inwardly extending diametrically opposed ribs extending longitudinally therein with an annular rubber cushion configured to fit within the housing in engagement with the ribs, the cushion being split at least partially along the length thereof on a plane transverse to a plane through the ribs. The bottom of the housing is provided with an aperture centrally disposed with respect to the axis of the housing, the aperture having pivotally mounted therein a trunnion supporting a wheel and axle assembly. The cushion is adapted to receive a member having a main body portion generally configured to fit within the opening of the cushion, the member having diametrically opposed outwardly extending flanges, each of said flanges having a downwardly extending wedge-shaped cross section for positioning within the split of the cushion. A retainer washer is provided with a cross section slightly smaller than the cross section of the housing to encompass the opening thereof and to abut against the upper surface of the cushion, with a trunnion bolt extending through the retainer, through the wedge member and through the trunnion to the exterior thereof with an adjusting nut holding the assembly in position. The trunnion bolt has a square cross section for fitting through a similarly configured opening in the trunnion wedge member and a similarly configured opening in the trunnion whereby the flanges compress the cushion segments circumferentially in the direction of pivotal movement thereof against the adjacent rib during operation of the truck. The amount of circumferential compression is adjusted by tightening or loosening the adjusting nut of the trunnion bolt which effects an axial adjustment of the volume of the cushion confined within the housing.

The features of the present invention which are believed to be novel, are set forth with particularity in the appended claims. The present invention, both as to its organization and manner of operation, together with further objects and advantages thereof, may best be understood by reference to the following description taken in conjunction with the accompanying drawings in which like-reference characters refer to like elements in the several views.

DESCRIPTION OF THE PREFERRED EMBODIMENT

Figure 1:
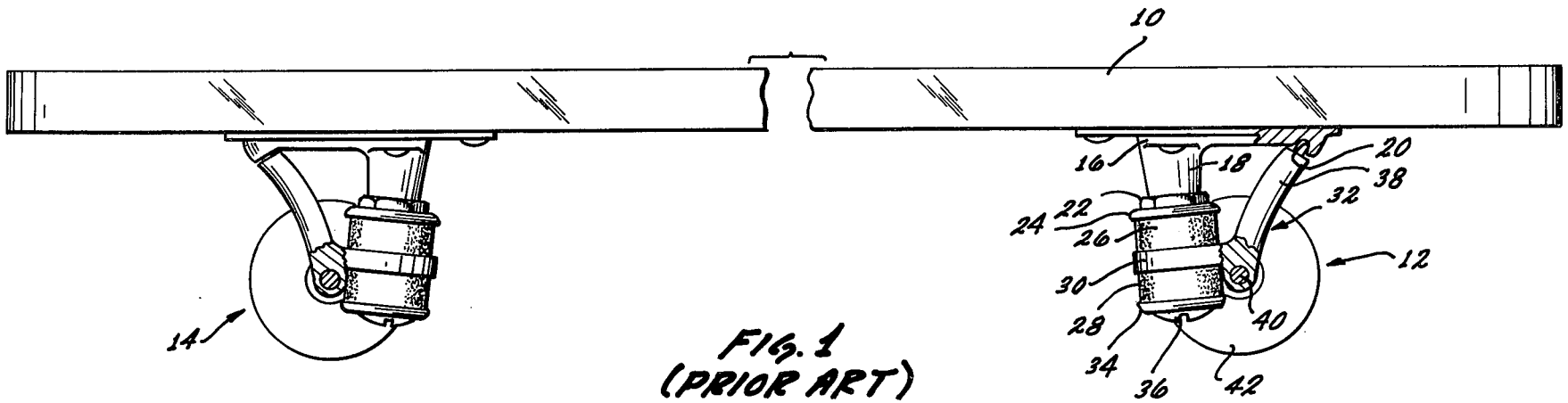
FIG. 1 (PRIOR ART)
FIG. 1 is a side elevational view partially in cross section of a skateboard according to the prior art.

Referring now to the drawings and more particularly to FIG. 1, there is shown a skateboard 10 having affixed thereto a pair of trucks generally designated 12 and 14, of conventional configuration. The trucks 12 and 14 are essentially identical although, positioned on the skateboard 10 in facing relationship to provide axes of pivoting in such a manner that an operator can steer the skateboard 10 by shifting his weight to one side or another. Since both trucks 12 and 14 are identical, the construction of truck 12 will be discussed in detail although like-reference numerals will be applied to both trucks for like parts. The truck 12 is provided with a mounting plate 16 which is suitably secured to the skateboard 10, the mounting plate 16 having depending downwardly therefrom a bolt member 18 at one end of mounting plate 16 with a socket 20 configured in the other end thereof, the socket 20 and the bolt 18 being generally disposed along the longitudinal center line of the board 10. The bolt 18 is threaded and provided with a lock nut 22 which engages a washer-shaped rebound ring 24 made of metal. Positioned on bolt 18 is a first rubber cushion 26 in the form of a thick washer and a second cushion 28 similarly configured. Sandwiched therebetween is a circular flange 30 outwardly extending from a trunnion 32, the cushions 26 and 28 being retained against opposing surfaces of the flange 30 by means of a second rebound ring 34 and an adjusting screw member 36.

The trunnion 32 has an upwardly diverging arm portion 38 terminating in a ball for pivotal retention within socket 20 when the trunnion 32 is assembled in the manner shown in FIG. 1. The lower end of trunnion 32 is provided with a transversely extending axle 40 suitably supporting two wheels only one wheel 42 of which is shown, the wheels 42 being adapted to engage a surface with the axle 40 being generally parallel to the plane of the board 10 with the board parallel to the surface.

In the conventional truck illustrated in FIG. 1, two axes are created, the first axis being the steering axis which is generally aligned along the axis of arm 38 of trunnion 32, this line extending inwardly toward the center of the skateboard 10 to provide an offset axis of rotation for the axle 40. The second axis is the rebound axis which is generally a line through the center of bolt 18, the bolt 18 extending through an aperture (not shown) in flange 30 of trunnion 32, the aperture being elongate or eccentric to enable a limited amount of relative movement between flange 30 and bolt 18. This rebound occurs as a result of the cushions 26 and 28 which are generally compressed against opposing surfaces of flange 30 by means of the rebound rings 34 and 24 being urged together by the adjusting screw 36. In operation, when the operator of the skateboard 10 shifts his weight, the plane of the board 10 tilts with respect to the surface upon which he is riding. When this happens, one edge of the board is forced closer to the ground, but since the wheels maintain the axle parallel to the surface upon which the wheels are riding, the wheels 42 along the edge closer to the ground are forced inwardly toward the center of the board 10 by means of the trunnion 32 rotating about bolt 18 by means of the aperture in flange 30. When this occurs, the half of the upper rebound ring 24 on the side of the lower edge of skateboard 10 is compressed and simultaneously has a shearing force applied to its surface by the pivoting movement of the flange 30 with respect to the bolt 18. At the same time, the same forces are applied to the opposite half of the lower cushion 28. During successive maneuvers with the skateboard 10, this action is repeated and reversed depending upon the direction of travel of the user. In any event, the net effect is that, since the cushions 28 and 26 are compressed against the flange 30 by means of the respective rebound rings 34 and 24, the frictional engagement of the rebound ring with its respective cushion creates a resistance in the cushion to rotation. However, likewise, due to the frictional engagement of the broad bearing surface of opposing surfaces of flange 30 engaging the respective cushions 26 and 28 the flange 30 during pivoting forces the coacting surface of each of the cushions to rotate thereby generating torsional or shearing forces in the rubber cushions 26 and 28 in a plane transverse to the bolt 18. Due to the construction of the conventional truck in this manner, a nonlinear resilient response results, that is, the force applied by cushions 26 and 28 to resist rotation of trunnion 32 is not the same for all angles of rotation thereof. The further the trunnion 32 is rotated, the more compression and shearing are applied to the cushions due to the increasing area of rebound rings 24 and 34, which encircle the cushions, being brought into contact with the cushions 26 and 28, thus resulting in nonlinear response with a lag time in returning the trunnion 32 to its at-rest position. With this two-axes configuration, the scope of rotation of trunnion 32 about the steering axis through arm 38 is limited as a consequence of the rebound axis being displaced from the steering axis.

Figure 2:
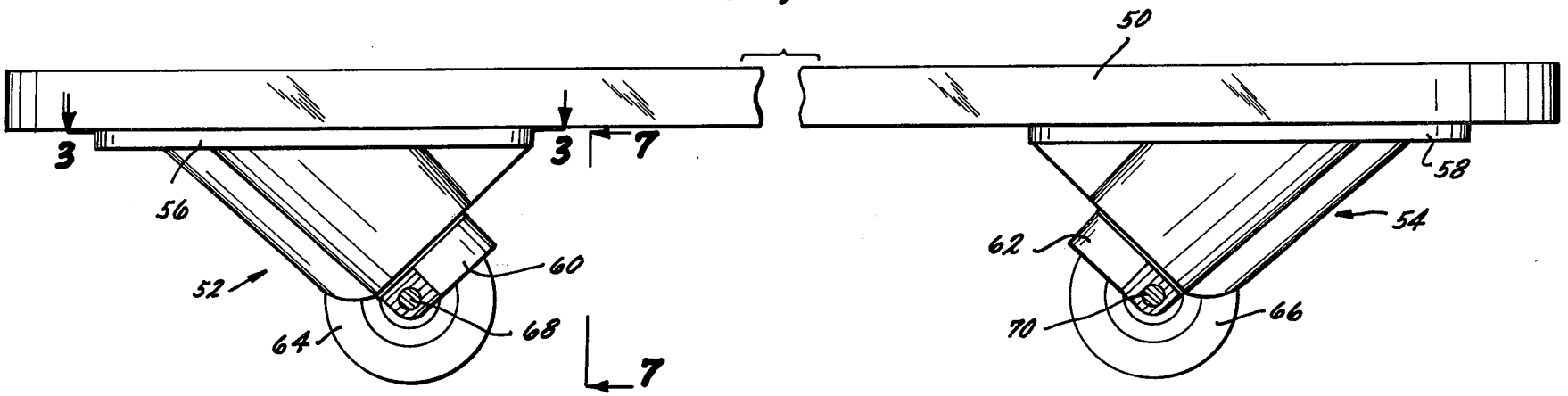
FIG. 2 is a side elevation of a skateboard utilizing the trucks according to the present invention.

Referring now to FIG. 2, there is shown a skateboard according to the present invention, in which the board 50 is provided with a pair of trucks 52 and 54 each having a single axis downwardly diverging toward the center of the board 50. Each of the trucks 52 and 54 is suitably secured to the board 50 by a mounting member 56 and 58 respectively, each of the trucks 52 and 54 having pivotally secured to the bottoms thereof, trunnions 60 and 62 respectively with each of the trunnions supporting a pair of wheels only one wheel 64 and 66 respectively being illustrated, the wheels being supported on axles 68 and 70 respectively.

Figure 3:
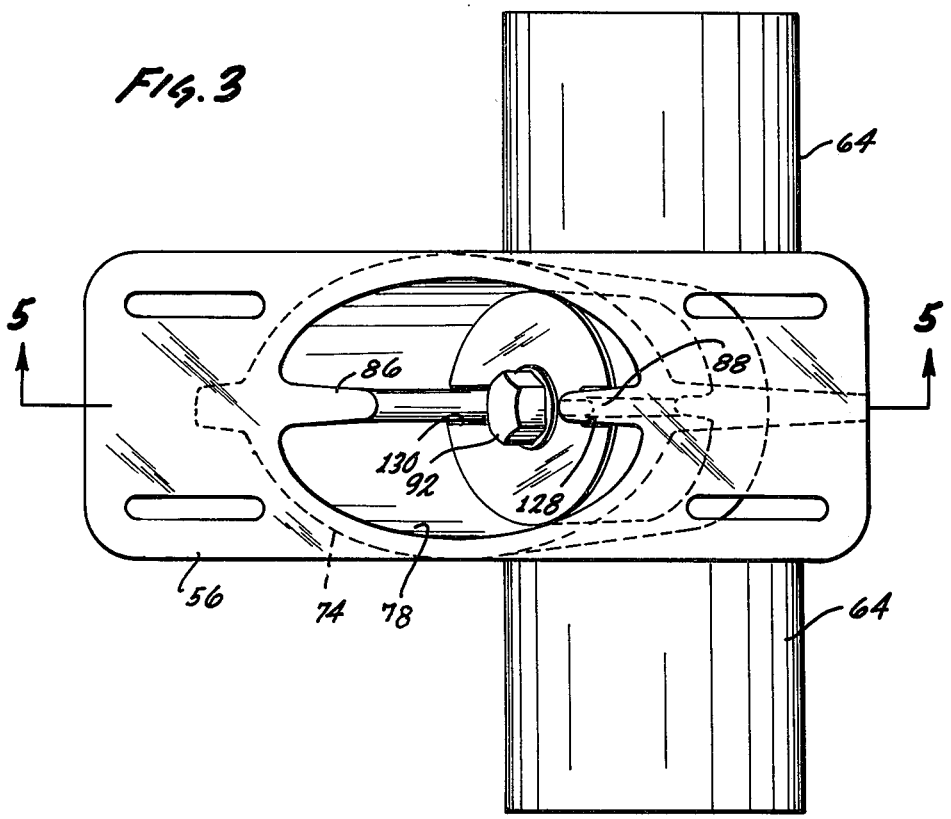
FIG. 3 is a plan-view of the truck of FIG. 2 taken along line 3—3 thereof.
Figure 5:
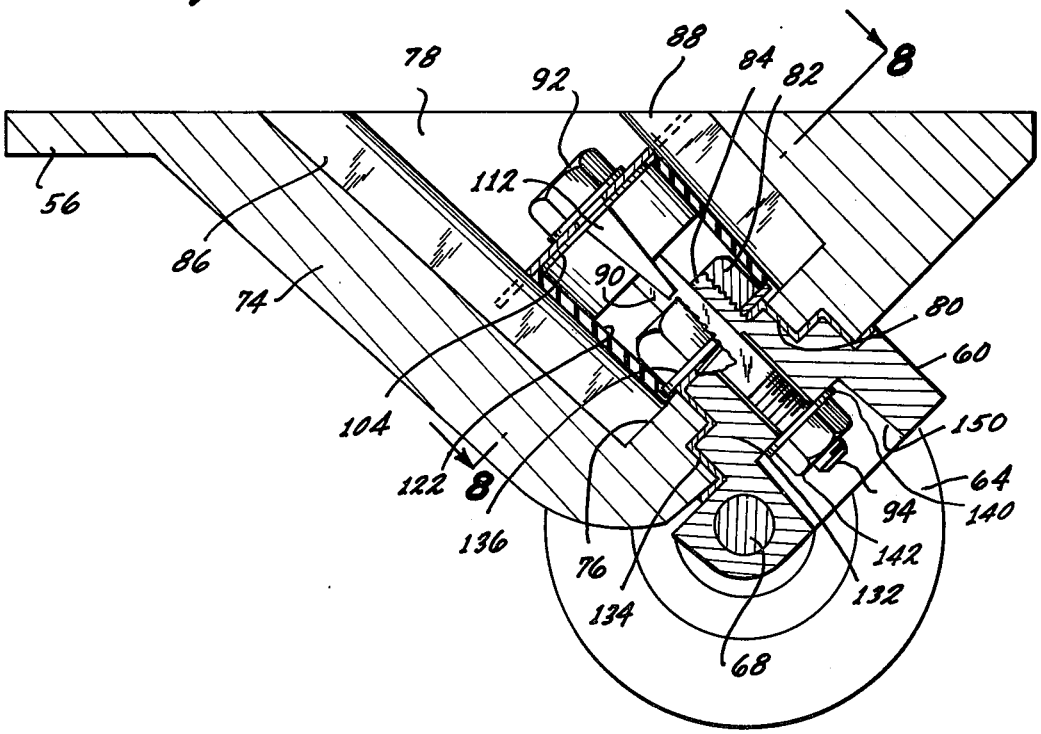
FIG. 5 is a cross-sectional view of the truck taken along line 5—5 of FIG. 3.
Figures 4, 6:
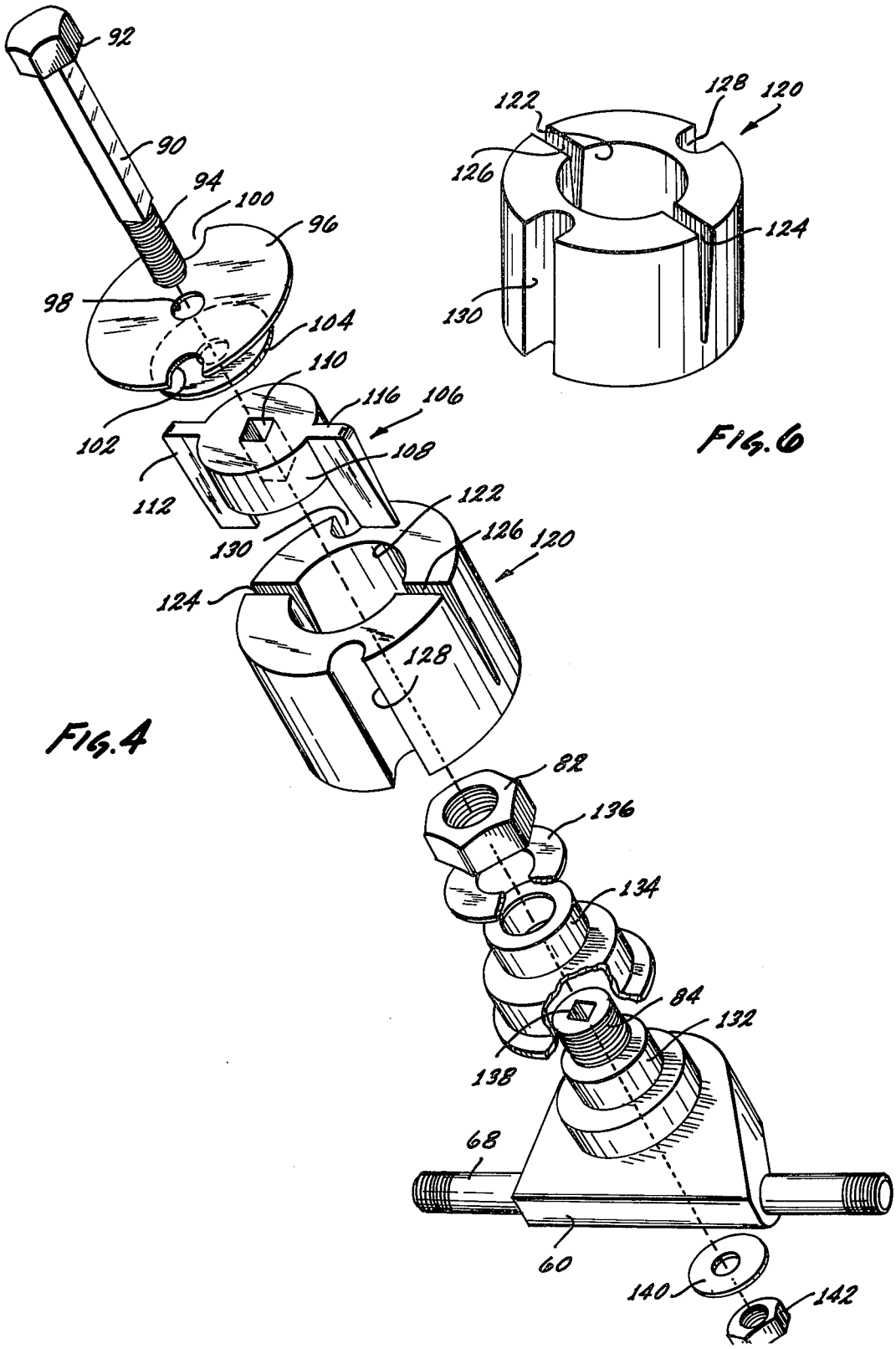
FIG. 4 is an exploded perspective view of the components utilized in the truck.
FIG. 6 is an enlarged perspective view of the cushion member shown in FIG. 4.
Figure 7:
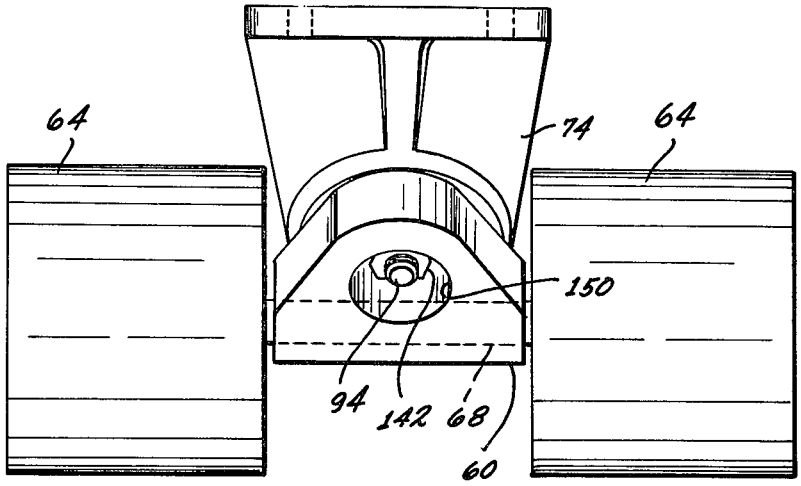
FIG. 7 is an end view of the truck taken along line 7—7 of FIG. 2.

Referring now to FIGS. 3 through 5, the construction of one of the trucks 52 will be discusses in detail, the other truck 54 being configured identically. Downwardly depending from the mounting plate 56 is a generally cup-shaped housing 74 having a bottom 76 with the open end 78 thereof extending through the mounting plate 56, the housing 74 having a generally circular cross section with the axis thereof disposed at approximately 45 degrees to the plane of the mounting plate 56. An aperture 80 extends through the bottom 76 along the axis of housing 74 and pivotally secured therein is the trunnion 60, the trunnion 60 having generally cylindrical stepped portions matingly engaging the aperture 80 with a lock nut 82 engaging the threaded neck portion 84 of trunnion 60 within the housing 74.

As shown in FIGS. 3 and 5, the inner surface of the housing 74 is provided with a pair of diametrically opposed inwardly extending longitudinal ribs 86 and 88 which extend in a direction perpendicular to the axis of rotation of wheels 64. The components which are assembled internally and externally of housing 74 are illustrated in FIG. 4 and include a trunnion bolt 90 of polygonal or square cross section having a bolt head 92 on end thereof and a threaded circular shaft portion 94 on the other end thereof. A retainer washer 96 has an aperture 98 therein for receiving the trunnion bolt 90, the periphery of retainer washer 96 being configured with diametrically opposed cutouts 100 and 102 adapted to matingly engage ribs 86 and 88 respectively within housing 74. A washer 104 is provided, made of self-lubricating plastic material or the like, the washer 104 having a central aperture for fitting over trunnion bolt 90. Next in order is compression member 106 having a central body portion 108 of generally circular configuration with an axially aligned polygonal or square aperture 110 therein for receiving the similarly configured portion of trunnion bolt 90 for concurrent rotation therewith. Outwardly extending from either side of the main body portion 108 are diametrically opposed fins or flanges 112 and 116, each having a downwardly depending wedge-shaped cross section with a length in the axial direction longer than the length of the main body portion 108. A cushion member 120 made of rubber or a suitable rubber compound has a generally annular cross-sectional configuration with the inner opening 122 thereof having a diameter approximately the same as the diameter of the main body portion 108 of compression member 106 for receiving the main body portion therein. The cushion 120 is split longitudinally to form two openings 124 and 126 for receiving flanges 112 and 116 respectively therein. With the cushion 120 within housing 74, the openings 124 and 126 are diametrically along a plane generally parallel to the axle 68 of trunnion 60 and perpendicular to a diameter extending between grooves 128 and 130 formed longitudinally in the outer surface of cushion 120, the grooves 128 and 130 being adapted to engage ribs 88 and 86 respectively within housing 74. The mating engagement of grooves 128 and 130 with ribs 88 and 86 restrain the cushion 120 from rotation by providing broad restraining surfaces.

As previously discussed, the trunnion 60 is provided with a stepped circular-bearing portion 132 and terminates at its upper end with a necked-down threaded portion 84. A similarly configured bearing member 134, made of a self-lubricating plastic material, fits over the stepped bearing portion 132 of trunnion 60 with the threaded portion 84 extending therethrough for receiving a washer 136 and locking nut 82 after the trunnion 60, along with the bearing 134, is inserted into the aperture 80 in bottom 76 of housing 74. The trunnion 60 is provided with an axially extending polygonal or square aperture 138 through which the trunnion bolt 90 passes for the threaded portion 94 thereof to receive a washer 140 and an adjusting nut 142. After assembly, the compression member 106 rotates concurrently with the trunnion 60 during pivotal movement thereof by virtue of the square cross section of trunnion bolt 90, which has a length sufficient to engage the square aperture 110 of compression member 106 and the square aperture 138 of trunnion 60.

Referring now to FIG. 5, the truck is illustrated in its assembled condition, the assembly being accomplished in the following manner. The bearing 134 is positioned over the stepped bearing portion 132 of trunnion 60, which is then positioned over the threaded portion 84 of trunnion 60 and the lock nut 82 is threadable fastened to the neck portion 84, thereby rotatably securing the trunnion 60 to the bottom 76 of the housing 74 of truck 52. As can be seen in FIG. 5, the axis of rotation of wheel 64, as defined by axle 68, is offset from the axis of housing 74. The cushion 120 is then inserted into the housing 74 with the grooves 128 and 130 engaging ribs 88 and 86 respectively, the inner opening 122 of cushion 120 being slightly larger than the greatest diameter of locking nut 82. The compression member 106 is then fitted with the fins or flanges 112 and 116 respectively engaging the openings 124 and 126 of cushion 120. As can be seen, the flanges 112 and 116 are on a plane parallel to the at-rest position of axle 68 and the ribs 86 and 88 are on a plane perpendicular thereto, both planes intersecting the axis of housing 74. The trunnion bolt 90 is then passed through the retainer 96 and the washer 104 through the square aperture 110 of compression member 106 and then through the square aperture 138 of trunnion 60 which is provided with a recess 150 in the lower surface thereof to receive the washer 140 and the adjusting nut 142 which is then tightened down to maintain the parts in the assembled condition shown in FIG. 5. In this condition, the cushion 120 has the outer diameter thereof confined by the inner walls of housing 74, the bottom 76 of housing 74 and the broad configuration of retainer washer 96 which has an overall configuration just slightly smaller than the inner configuration of housing 74. In this manner, the volume of the cushion 120 is determined by adjustment of the adjusting nut 142, which effectively varies the compressive force transmittable by the resilient rubber cushion 120. By axially tightening adjusting nut 142, the axial length of cushion 120 is decreased thereby decreasing the volume and increasing the density thereof. The surfaces of flanges 112 and 116 are slightly smaller than the coacting surfaces of cushion 120 formed by slits 124 with the adjustment nut 142 tightened to its maximum position.

Figure 8:
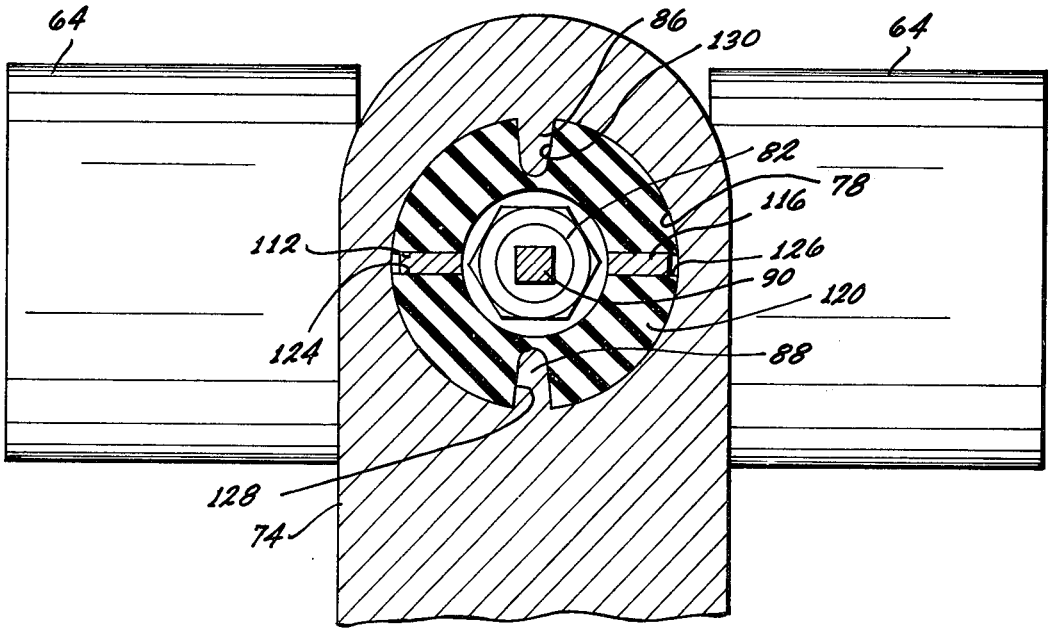
FIG. 8 is a cross-sectional view taken along line 8—8 of FIG. 5.

As shown in FIG. 8, the flanges 112 and 116 fit deep within the openings 124 and 122 respectively of cushion 120. The cushion 120 is effectively divided into four quadrants, these being a first quadrant between flange 116 and rib 88; a second quadrant between rib 88 and flange 112; a third quadrant between flange 112 and rib 86; and a fourth quadrant between rib 86 and flange 116. Each of the quadrants is essentially identical in volume and circumferential lengths. In operation, as an operator tilts the skateboard so that the wheels 64 are rotated clockwise with respect to the axis of trunnion bolt 90, the first and third quadrants are compressed with the forces being applied in a clockwise circumferential direction from flange 116 toward rib 88 and from flange 112 toward rib 86. In this manner, each of the flanges 116 and 112 have a broad surface coacting in a strictly compressive manner against the broad surface of the adjacent cushion quadrant, which force is resisted by the broad surface of longitudinally extending restraining ribs 88 and 86 respectively. Similarly, if the wheels 64 are rotated in a counter-clockwise direction about the axis of trunnion bolt 90, the second and third quadrants are similarly compresses. As the adjusting nut 142 is tightened down, the internal compression of the cushion 120 is increased by the axial pressure of the retainer washer acting upon the cushion 120 to reduce its volume. Furthermore, the confined cushion can only expand downwardly and inwardly thereby positioning the wedge flanges 112 and 116 deeper within the cushion and increasing the ratio of flange surface to adjacent quadrant surface to thereby assist to increase the resistance to compression of the cushion 120.

With a skateboard truck constructed in accordance with the present invention, the steering axis and the rebound axis are one and the same, both axes being along the axis of trunnion bolt 90, which is the axis of cup-shaped housing 74.

Due to the inherently identical resilience of each of the quadrants of the cushion 120, the self-centering characteristics of the truck are positive with no lag and substantial linearity of response. Because each quadrant of cushion 120 is identical in volume at rest, and because each fin or flange 112 and 116 is identical in the size of the area coacting against the adjacent surface of the quadrant, the result is equal areas of bearing surfaces acting on equal volumes of opposing quadrants of the cushion 120 to provide a linear response during rotation of the trunnion 60. In the conventional truck, discussed with reference to FIG. 1, the amount of surface area of the rebound rings 24 and 34, in contact with or acting upon its respective cushion 26 amd 28, varies with the angle of rotation of the trunnion 32 thereby resulting in a nonlinear response.

By viewing FIG. 8, substantially identical counter-clockwise forces are generated by the compression of the first and third quadrants of cushion 120 to urge the flanges 112 and 116 back to the position indicated in FIG. 8. The cushion 120, during operation of the truck 52, has opposing quadrants substantially in compression at all times with virtually no shearing force imparted to the cushion 120. Furthermore, by utilization of a single axis, the axis of rotation of the trunnion 60 has more freedom than in the prior art shown in FIG. 1, where the prior art configuration has the rebound axis and the steering axis working against each other with the rebound axis being fixed and the steering axis being transverse thereto with a coupling being effected by the aperture within flange 30 receiving the bolt 18 thereby providing a rotation limiting factor.

While there has been shown and described a preferred embodiment, it is to be understood that various other adaptations and modifications may be made within the spirit and scope of the invention.

What is claimed is:

1. In a truck for use with a skateboard or the like, the combination comprising:

a generally cup-shaped housing having an open end and a bottom;

mounting means secured to said housing adjacent said open end, said mounting means extending in a plane transverse to the axis of said housing, trunnion means rotatably secured to the bottom of said housing for rotation on said axis;

cushion means within said housing, said cushion means being circumferentially positioned about said axis; and other means within said housing coupled for rotation with said trunnion means, said other means having portions thereof engaging said cushion means whereby to apply circumferential compressive forces to parts of said cushion means upon pivoting of said trunnion means.

2. The combination according to claim 1 wherein said cushion means has a generally annular cross section and said housing has a generally circular cross section.

3. The combination according to claim 2 further including means for restraining said cushion means from rotation within said housing.

4. The combination according to claim 3 wherein said restraining means includes rib means formed within said housing and said cushion means is grooved to fit said rib means.

5. The combination according to claim 4 wherein said rib means is a pair of diametrically opposed longitudinal ribs on the interior surface of said housing.

6. The combination according to claim 5 wherein said other means is a member having a main body portion received within the aperture of said cushion means, said member having diametrically opposed flanges inserted within said cushion means on a plane generally transverse to the plane of said ribs, said flanges coacting with adjacent surfaces of said cushion means for resiliently deforming said cushion means during pivoting of said trunnion.

7. The combination according to claim 6 wherein each of said flanges has a wedge-shaped cross section extending toward the bottom of said housing.

8. The combination according to claim 7 wherein said member is coupled to said trunnion means by a trunnion bolt.

9. The combination according to claim 8 further including retaining means within said housing engaging the end of said cushion means opposite said bottom and said trunnion bolt extends through said retaining means.

10. The combination according to claim 9 wherein said trunnion bolt extends through said trunnion means and has a threaded portion engaging an adjusting nut, the adjustment of said nut compressing said cushion means in an axial direction between said retaining means and said bottom whereby to vary the circumferential compressive forces.

11. The combination according to claim 10 wherein siad retaining means includes a washer having a cross sectional configuration generally the same as the interior of said housing.

12. The combination according to claim 11 wherein said trunnion bolt has a body portion having a polygonal cross section engaging matingly configured apertures in said member and said trunnion means for coupling said member to said trunnion means.

13. The combination according to claim 12 wherein said trunnion means includes an axle and a pair of wheels supported at the outer ends thereof, and the flanges of said member are in a line parallel to said axle.

14. The combination according to claim 13 wherein said mounting means is a plate mounted at an angle of approximately 45° to the axis of said housing.

* * * * *